US012403521B2

(12) United States Patent
Chang

(10) Patent No.: US 12,403,521 B2
(45) Date of Patent: Sep. 2, 2025

(54) EDGE BAND FINE TRIMMING MECHANISM OF EDGE BANDING MACHINE

(71) Applicant: OAV EQUIPMENT AND TOOLS, INC., Taichung (TW)

(72) Inventor: Yen-Tsung Chang, Taichung (TW)

(73) Assignee: OAV EQUIPMENT AND TOOLS, INC., Taichung (TW)

( * ) Notice: Subject to any disclaimer, the term of this patent is extended or adjusted under 35 U.S.C. 154(b) by 393 days.

(21) Appl. No.: 18/086,079

(22) Filed: Dec. 21, 2022

(65) Prior Publication Data

US 2023/0302521 A1 Sep. 28, 2023

(30) Foreign Application Priority Data

Mar. 28, 2022 (TW) ..... 111111719
Oct. 25, 2022 (TW) ..... 111140461

(51) Int. Cl.
*B21D 31/00* (2006.01)

(52) U.S. Cl.
CPC ..... *B21D 31/00* (2013.01)

(58) Field of Classification Search
CPC ..... B21D 31/00; B27D 5/006; B26D 1/00; B26D 7/18; B26D 1/147; B26D 7/0675; B26D 1/52; B26B 69/0033; B23D 55/046; B23D 53/005; B23D 55/082; B23D 61/126; B42C 11/04; Y10T 83/6633; Y10T 83/2192; Y10T 83/2083; Y10T 83/741; Y10T 83/8884; Y10T 83/8889; Y10T 83/937264
USPC ... 83/869, 794, 107, 155.435, 2, 933, 155.1, 83/446, 54, 449, 444, 94, 6, 368, 404, 83/422, 425.2, 428.661; 53/50, 381.2, 53/492; 414/412; 30/2
See application file for complete search history.

(56) References Cited

U.S. PATENT DOCUMENTS 2,729,885 A * 1/1956 Wahl ..... B65B 69/0033 414/412
3,424,357 A * 1/1969 Huffman ..... C03B 33/037 83/402

(Continued)

FOREIGN PATENT DOCUMENTS

KR 20100088422 A * 8/2010 ..... B23C 3/12
KR 20140010238 A * 1/2014 ..... B23C 3/12

*Primary Examiner* — Ghassem Alie
(74) *Attorney, Agent, or Firm* — Muncy, Geissler, Olds & Lowe, P.C.

(57) ABSTRACT

An edge band fine trimming mechanism of an edge banding machine includes a fixed seat including a scraper installation groove extending vertically, a first feeler wheel assembly including a first feeler wheel vertically and rotatably disposed on the right side of the fixed seat, a second feeler wheel assembly including a second feeler wheel horizontally and rotatably disposed on the bottom side of the fixed seat, and a scraper assembly. The aforementioned scraper assembly is disposed on the fixed seat and includes a blade holder and a blade. The blade holder includes vertical and inclined sections connected with each other. The vertical section is disposed in the scraper installation groove in a vertically movable manner. The blade is disposed at the terminal end of the inclined section. The edge band fine trimming mechanism enables fast positional adjustment for the scraper and the associated feeler wheel.

9 Claims, 5 Drawing Sheets

(56) References Cited

U.S. PATENT DOCUMENTS 3,888,150 A * 6/1975 Stroud ..... B26D 1/52
83/425.2
5,101,703 A * 4/1992 Tanaka ..... B65B 69/0033
83/368
6,591,722 B1 * 7/2003 Sauer ..... B26D 1/147
198/689.1

* cited by examiner

EDGE BAND FINE TRIMMING MECHANISM OF EDGE BANDING MACHINE

BACKGROUND OF THE INVENTION

1. Field of the Invention

The present invention relates to an edge band fine trimming mechanism of an edge banding machine and specifically speaking, to an edge band fine trimming mechanism which enables relatively easier positional control for a scraper.

2. Description of the Related Art

As to the traditional edge banding machine, refer to FIG. 1, wherein an edge banding machine 1 is illustrated, which includes a base 10, a set of slideway 20, a positioning pressing wheel set (not shown), and a plurality of other mechanisms including a pre-milling mechanism 30, a glue applying mechanism 40, an edge band conveying mechanism 50, a horizontal pressing wheel set 60 and an edge band fine trimming mechanism 70. The slideway 20 is movably disposed on the base 10. The positioning pressing wheel set is disposed above the slideway 20. A workpiece (not shown) to be processed is clipped between the slideway 20 and the positioning pressing wheel set, and can be moved. The pre-milling mechanism 30 performs a preliminary processing to the surface of the workpiece. The glue applying mechanism 40 applies glue to the surface of the workpiece. The edge band conveying mechanism 50 is adapted to convey an edge band to the workpiece applied with the glue. Then, the edge banding machine 1 cuts off the edge band by a cutter 51 and tightly presses the cut-off edge band to the workpiece by the horizontal pressing wheel set 60, so as to combine the cut-off edge band with the workpiece applied with the glue tightly. At last, the edge banding machine 1 further trims end edges of the edge band by the edge band fine trimming mechanism 70, so as to chamfer the end edges of the edge band.

In the edge trimming process by using the edge band fine trimming mechanism 70, it needs feeler wheels to keep a scraper of the edge band fine trimming mechanism 70 located at a fixed position relative to the workpiece, preventing the edge trimming process from causing an end edge of the edge band an appearance defect. According to what the inventor knows, the traditional scraper is structurally shaped as a linear rod, and arranged at an angle of 45 degrees with respect to the ground. Besides, the traditional scraper is adjusted along the linear extending direction of the scraper. Therefore, once the position of the scraper is adjusted, it will certainly change two of the positional coordinates of the blade tip of the scraper at the same time, resulting in that the technician for the edge banding machine 1 has to further correspondingly correct the positions of the feeler wheels in the following process, thereby causing inconvenience in correction. It is thus clear that the structural design of the edge band fine trimming mechanism 70 of the presently available edge banding machine 1 is imperfect and thereby still needs improvement.

SUMMARY OF THE INVENTION

It is one of the objectives of the present invention to make an improvement against the defects of the edge band fine trimming mechanism of the presently available edge banding machine, so as to bring up a brand-new configuration design of an edge band fine trimming mechanism of an edge banding machine, which enables fast and convenient positional adjustment for the scraper and the associated feeler wheel, lowering the inconvenience in correcting the scraper and the feeler wheel.

Therefore, an edge band fine trimming mechanism of an edge banding machine provided according to the present invention is applied to a workpiece with an edge band adhered thereto. The aforementioned edge band fine trimming mechanism includes a fixed seat, a first feeler wheel assembly, a second feeler wheel assembly, and a scraper assembly. The aforementioned fixed seat includes a scraper installation groove, and the scraper installation groove extends vertically. The aforementioned first feeler wheel assembly includes a first feeler wheel. The first feeler wheel is vertically and rotatably disposed on the front side of the fixed seat. The aforementioned second feeler wheel assembly includes a second feeler wheel. The second feeler wheel is horizontally and rotatably disposed on the bottom side of the fixed seat. The aforementioned scraper assembly is disposed on the fixed seat and adapted to trim an end edge of the edge band. The scraper assembly includes a blade holder and a blade. The blade holder includes a vertical section and an inclined section. The vertical section is disposed in the scraper installation groove in a vertically movable manner. The inclined section is connected to the bottom end of the vertical section and extends toward a boundary between the aforementioned first feeler wheel and the second feeler wheel. The blade is disposed at the terminal end of the inclined section.

As a result, when the edge banding process is to be performed to a workpiece of different size and thereby the position of the scraper assembly needs adjustment, the technician for the edge banding machine only needs to vertically adjust the scraper assembly along the scraper installation groove. During the adjusting process, only one of the coordinates of the blade tip of the scraper assembly is changed, so that the technician for the edge banding machine only needs to correspondingly adjust the position of the first feeler wheel in the following process to complete the entire correcting process for the edge band fine trimming mechanism. Therefore, the positions of the scraper and the associated feeler wheel can be adjusted fast and conveniently, that effectively lowers the inconvenience in correcting the scraper and the feeler wheel.

In one of the aspects, the aforementioned edge band fine trimming mechanism may be a top trimming mechanism or a bottom trimming mechanism for trimming a top end edge or a bottom end edge of the edge band respectively.

In another aspect, the fixed seat further has an upper threaded hole. The scraper assembly further includes a first adjusting screw. The first adjusting screw is screwed into the upper threaded hole of the fixed seat, and the terminal end of the first adjusting screw is connected with the blade holder.

Specifically, the scraper assembly further includes a first displacement sensor. The first displacement sensor is disposed on the first adjusting screw and measures the vertical displacement of the first adjusting screw.

In another aspect, the edge band fine trimming mechanism further includes a supporting frame and a second adjusting screw. The supporting frame is disposed on the fixed seat in a horizontally movable manner. The second feeler wheel is rotatably disposed at the terminal end of the supporting frame. The fixed seat further has a lower threaded hole. The second adjusting screw is screwed into the lower threaded hole of the fixed seat, and the terminal end of the second adjusting screw is connected with the supporting frame.

Specifically, the second feeler wheel assembly further includes a second displacement sensor. The second displacement sensor is disposed on the second adjusting screw and measures the horizontal displacement of the second adjusting screw.

In another aspect, the fixed seat has a fastening threaded hole. The vertical section has an elongated hole. A fastening screw is inserted through the elongated hole and screwed into the fastening threaded hole for adjusting the position of the scraper assembly.

In another aspect, the first feeler wheel assembly includes a plurality of first feeler wheels and a fixing member. The fixing member is disposed on the fixed seat in a vertically movable manner. The plurality of first feeler wheels are all vertically and rotatably disposed on the fixing member. The plurality of first feeler wheels are all located at a same predetermined height.

In another aspect, the scraper installation groove has a first inner wall and a second inner wall, which are arranged oppositely to each other. The peripheral surface of the blade holder fitly contacts the first inner wall and the second inner wall at the same time.

BRIEF DESCRIPTION OF THE DRAWINGS

The detailed structure, features, assembling or using manner related to the edge band fine trimming mechanism of the edge banding machine will be described in the following embodiment. However, it should be understood that the embodiment to be described in the following and the figures are given by way of illustration only, not limitative of the claimed scope of the present invention, and wherein:

DETAILED DESCRIPTION OF THE INVENTION

The technical content and features of the present invention will be described in detail by the following embodiment in coordination with the figures. The directional terms mentioned in the content of the specification, such as 'upper', 'lower', 'in', 'out', 'top', and 'bottom', are just for illustrative description on the basis of normal usage direction, not intended to limit the claimed scope.

For the detailed description of the technical features of the present invention, the following embodiment is instanced and illustrated in coordination with the figures. Wherein, for the convenience of illustrating the following embodiment, the direction of this embodiment will be based on that the workpiece W is located on the right side of the edge band fine trimming mechanism 10.

Figure 1:
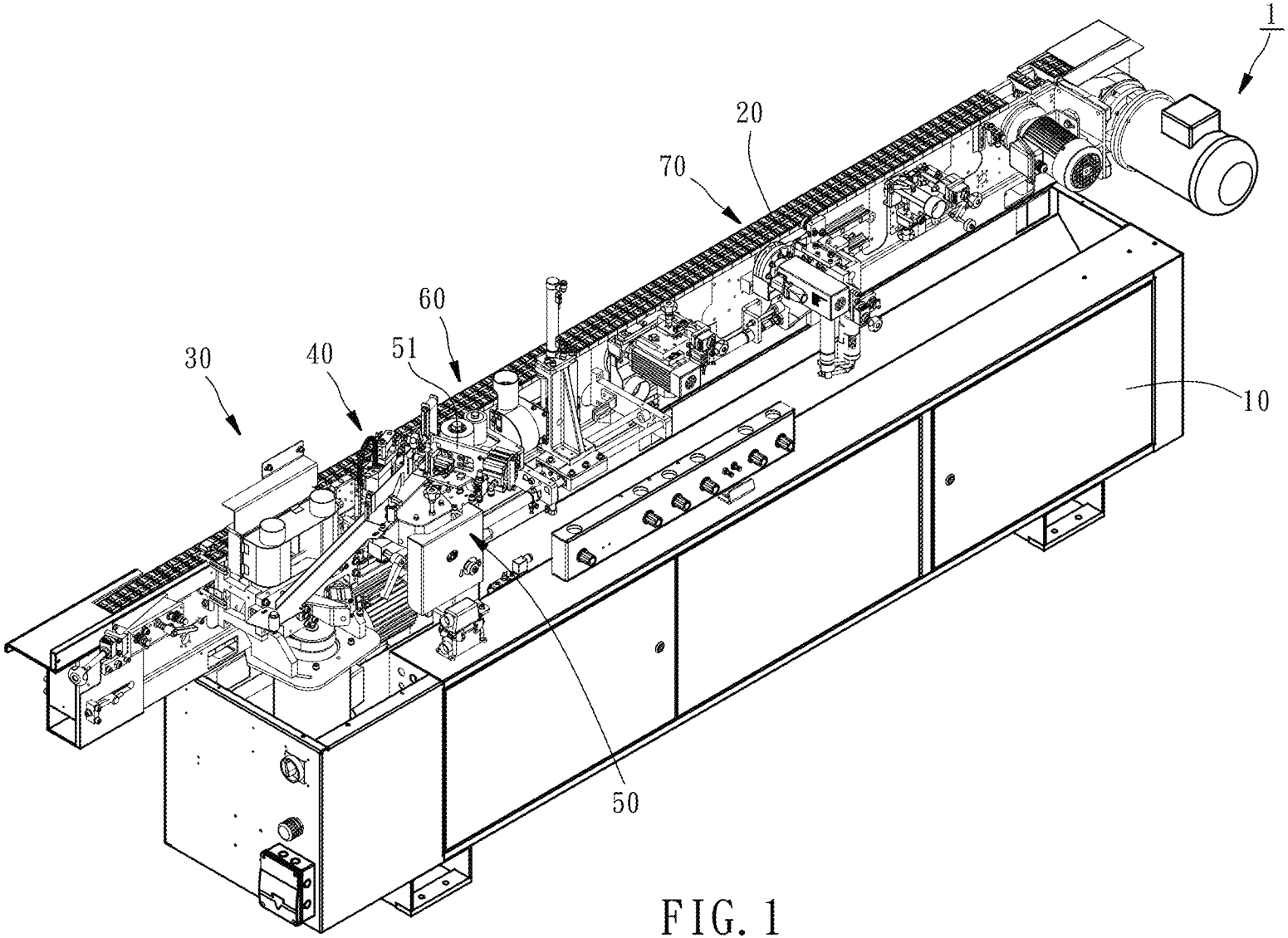
FIG. 1 is a perspective view of a conventional edge banding machine.
Figure 2:
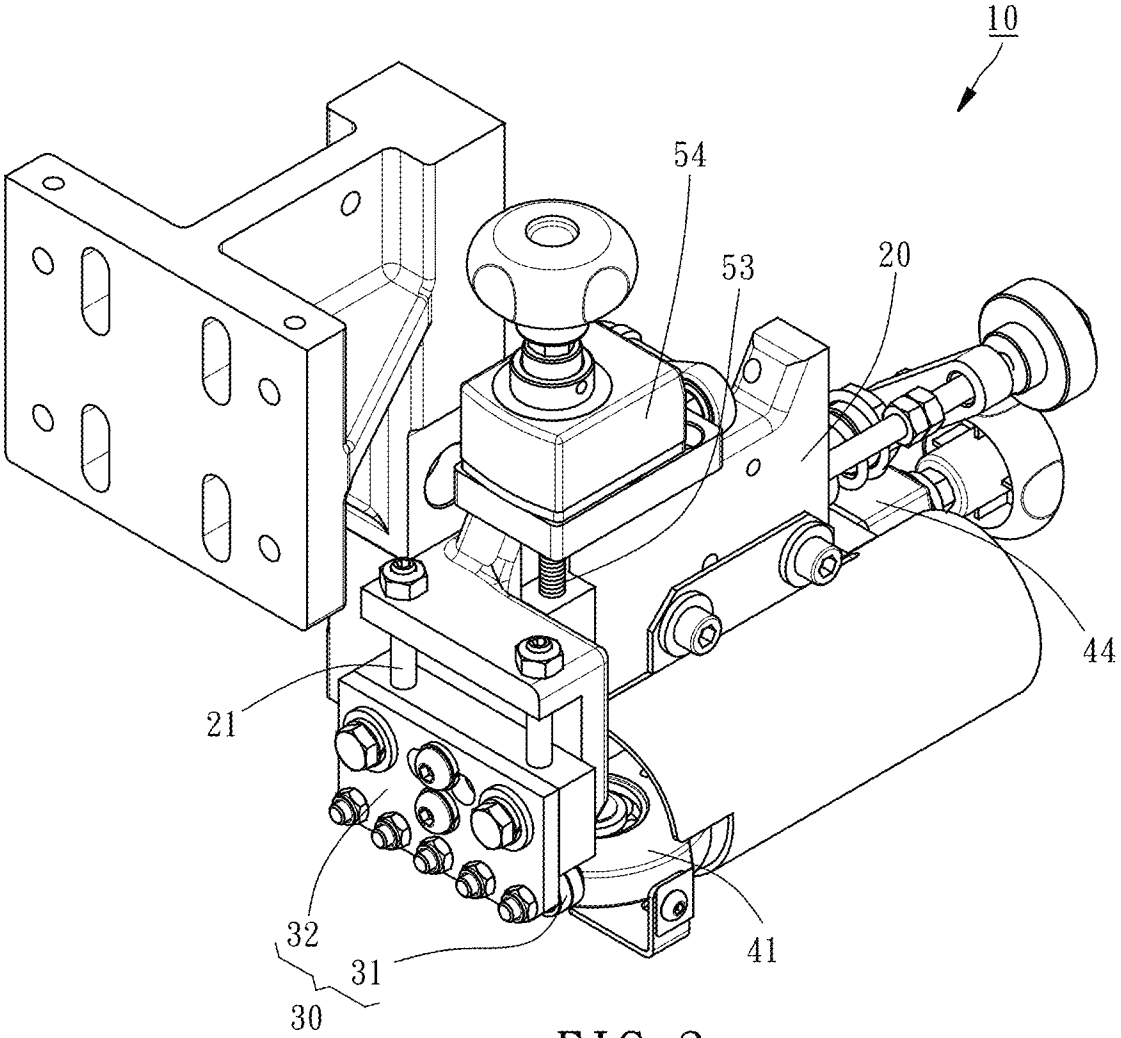
FIG. 2 is a perspective view of an edge band fine trimming mechanism of an edge banding machine of an embodiment.

As shown in FIG. 2, an edge band fine trimming mechanism 10 of an edge banding machine provided in the embodiment is applied to a workpiece W (shown in FIG. 5) with an edge band B adhered thereto for chamfering top, bottom, front and rear end edges of the edge band B. The workpiece W is disposed on a set of slideway R, and a set of positioning pressing wheel set P is abutted on the top surface of the workpiece W. The workpiece W is moved by the set of slideway R and the set of positioning pressing wheel set P.

Referring to FIG. 2 to FIG. 5, the aforementioned edge band fine trimming mechanism 10 includes a fixed seat 20, a first feeler wheel assembly 30, a second feeler wheel assembly 40, and a scraper assembly 50.

The fixed seat 20 is adapted for disposing the first feeler wheel assembly 30, the second feeler wheel assembly 40 and the scraper assembly 50, and the fixed seat 20 is fixed on a base of the edge banding machine. The fixed seat 20 is provided on the right side thereof with two guiding rods 21 extending vertically, and the fixed seat 20 is provided on the front side thereof with a scraper installation groove 22. The scraper installation groove 22 extends vertically and has a first inner wall 221 and a second inner wall 222, which are arranged oppositely to each other. The so-called 'extend vertically' means extending upwardly with respect to the ground.

The first feeler wheel assembly 30 includes five first feeler wheels 31 and a fixing member 32. The first feeler wheels 31 are vertically and rotatably disposed on the fixing member 32 and located on the right side of the fixed seat 20. The fixing member 32 is disposed on the two guiding rods 21 in a vertically movable manner. The so-called 'vertically disposed on the fixing member 32' means the axial directions of the axles of the first feeler wheels 31 are all parallel to the ground. The bottom ends of the first feeler wheels 31 all a little protrude out below the fixing member 32, and the first feeler wheels 31 are all located at a same predetermined height. The first feeler wheels 31 are in contact with the top surface of the workpiece W for determining the position of a top reference surface of the workpiece W.

Figure 3:
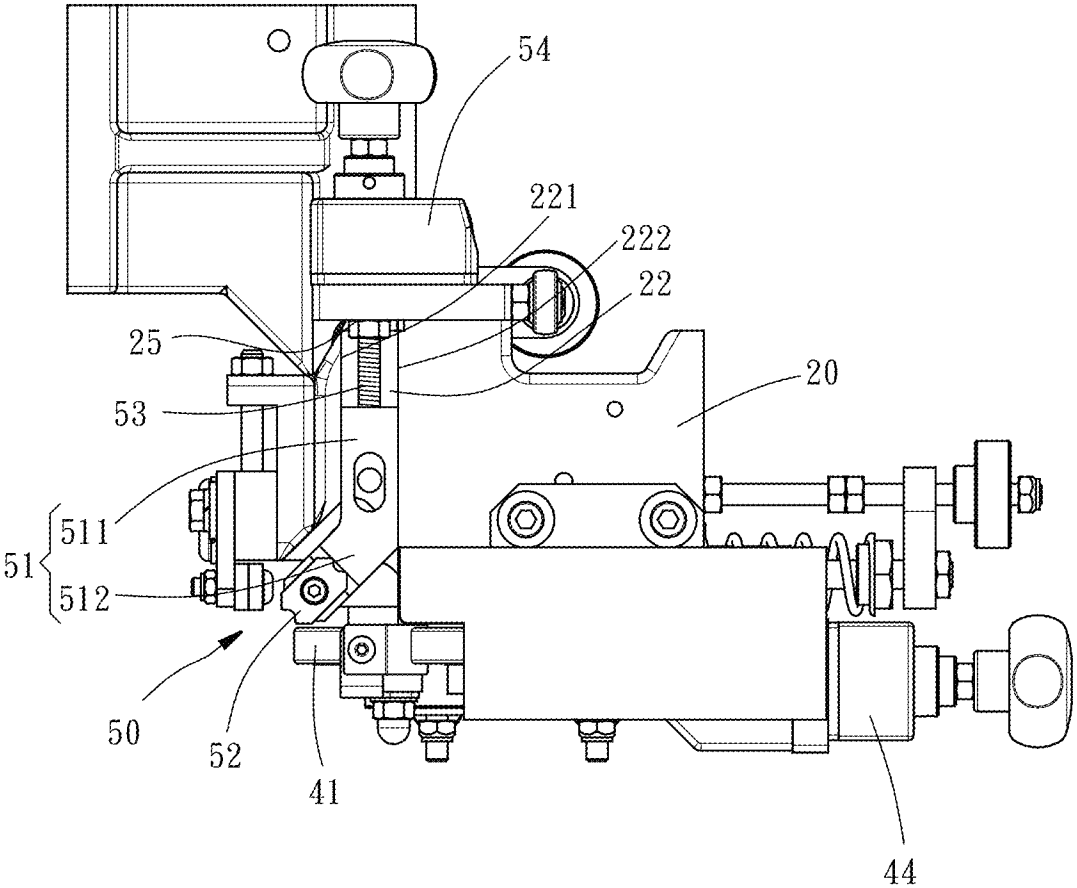
FIG. 3 is a lateral view of FIG. 2.
Figure 4:
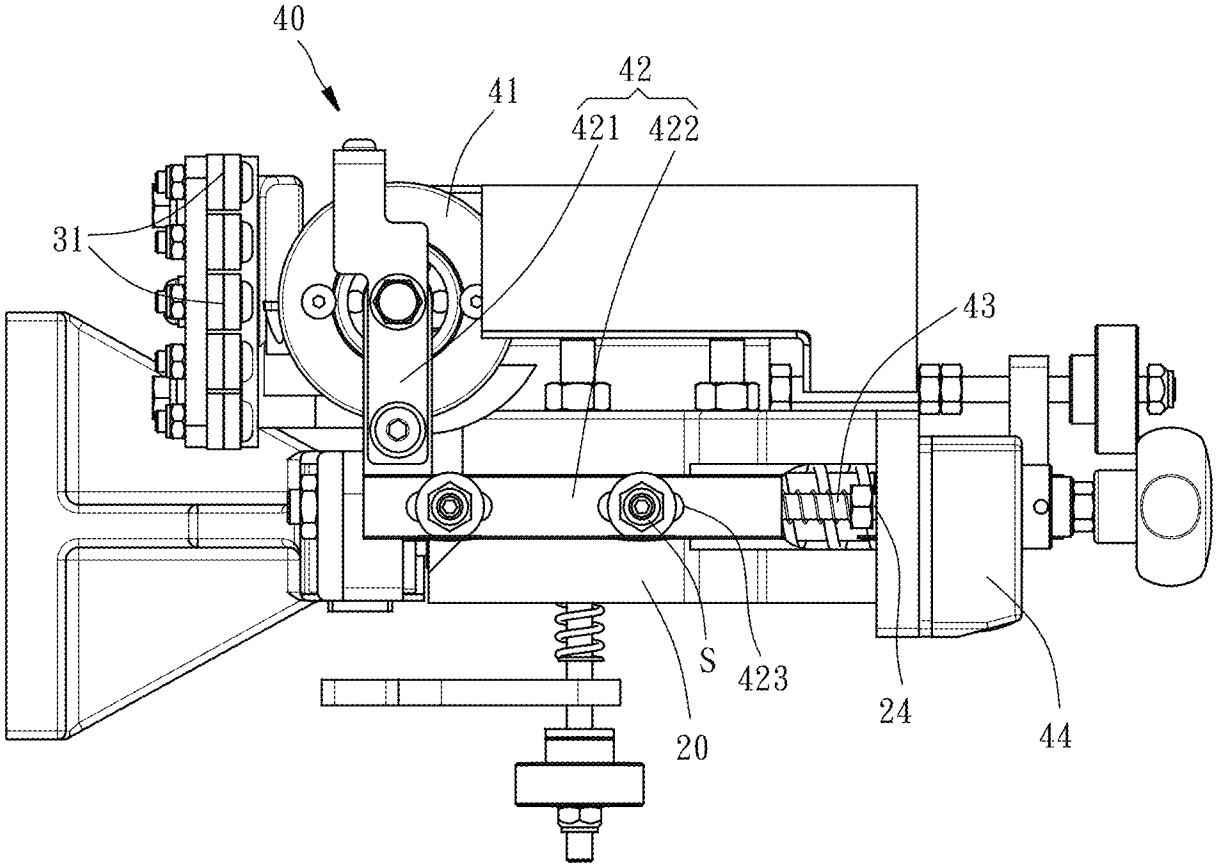
FIG. 4 is a bottom view of FIG. 2.

The second feeler wheel assembly 40 includes a second feeler wheel 41, a supporting frame 42, a second adjusting screw 43, and a second displacement sensor 44. The second feeler wheel 41 is horizontally and rotatably disposed on the bottom side of the fixed seat 20. The second feeler wheel 41 is in contact with the surface of the edge band B for determining the position of a lateral reference surface of the workpiece W with the edge band B adhered thereto. As shown in FIG. 3 and FIG. 4, the so-called 'horizontally disposed on the fixed seat 20' means the axial direction of the axle of the second feeler wheel 41 is vertical to the ground. The supporting frame 42 is disposed on the fixed seat 20 in a horizontally movable manner. The supporting frame 42 has a first section 421 and a second section 422, which are connected with each other. The first section 421 extends from the front to the rear. The second section 422 extends from the right to the left. The direction which the first section 421 extends toward is perpendicular to the direction which the second section 422 extends toward. The second feeler wheel 41 is rotatably disposed on the terminal end of the first section 421 of the supporting frame 42. The fixed seat 20 further has a lower threaded hole 24. The second adjusting screw 43 is screwed into the lower threaded hole 24 of the fixed seat 20, and a terminal end of the second adjusting screw 43 is connected to the second section 422 of the supporting frame 42. The other end of the second adjusting screw 43 is provided with a handle 45. The second displacement sensor 44 is disposed on the second adjusting screw 43 and measures the horizontal displacement of the second adjusting screw 43. Rotating the handle 45 can drive the supporting frame 42 to displace horizontally, thereby adjusting the position of the second feeler wheel 41. For effectively fixing the supporting frame 42, the second section 422 of the supporting frame 42 is provided with an elongated hole 423, and the bottom side of the fixed seat 20 is provided with a threaded hole (covered by a screw S and thereby not shown). The threaded hole is located correspondingly to the elongated hole 423. The screw S is inserted through the elongated hole 423 and screwed into the aforementioned threaded hole, so that the supporting frame 42 can be fixed to the fixed seat 20 by the screw S after being adjusted in position.

Figure 5:
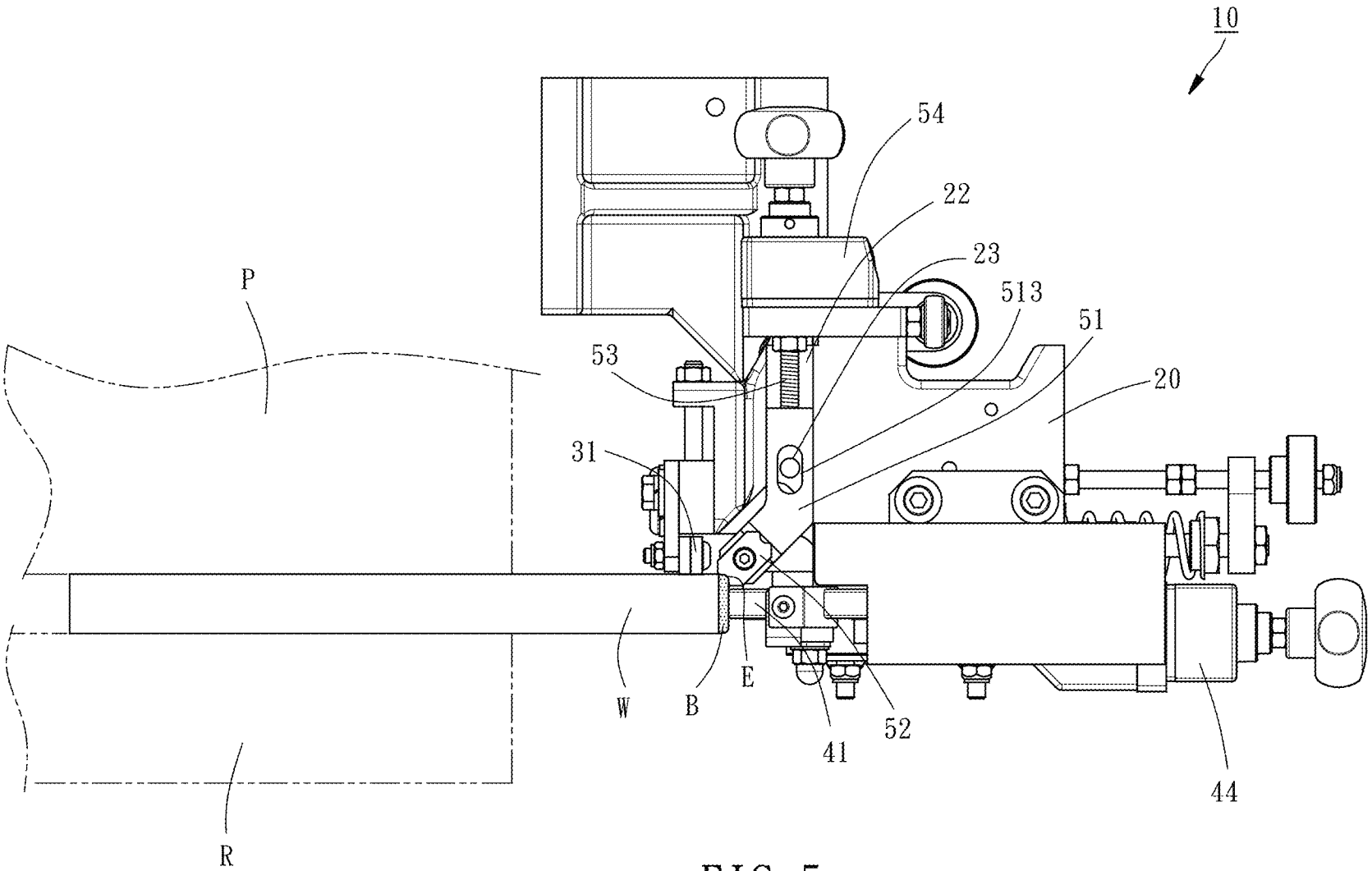
FIG. 5 is a schematic view showing the usage of the edge band fine trimming mechanism of the embodiment.

Referring to FIG. 3 and FIG. 5, the scraper assembly 50 is disposed on the fixed seat 20 and adapted to trim an end edge of the edge band B. The aforementioned end edge of the edge band B may be a top end edge, a bottom end edge, a front end edge or a rear end edge of the edge band B. The scraper assembly 50 structurally includes a blade holder 51, a blade 52, a first adjusting screw 53, and a first displacement sensor 54. The blade holder 51 includes a vertical section 511 and an inclined section 512. The vertical section 511 is disposed in the scraper installation groove 22 in a vertically movable manner, and the peripheral surface of the blade holder 51 fitly contacts the first inner wall 221 and the second inner wall 222 of the scraper installation groove 22 at the same time. The inclined section 512 is connected to the bottom end of the vertical section 511 and extends toward a boundary between the first feeler wheels 31 and the second feeler wheel 41. The blade 52 is disposed at the terminal end of the inclined section 512. For effectively fixing the blade holder 51 when the blade 52 and the blade holder 51 are adjusted together to the position corresponding to the top end edge E of the edge band B, the vertical section 511 of the blade holder 51 is provided with an elongated hole 513 (as shown in FIG. 5), and the fixed seat 20 is provided with a fastening threaded hole 23 (located in the elongated hole 513 in FIG. 5). A fastening screw (not shown) is inserted through the elongated hole 513 and screwed into the aforementioned fastening threaded hole 23, so that the blade holder 51 can be fixed in the scraper installation groove 22 of the fixed seat 20. The first adjusting screw 53 is screwed into an upper threaded hole 25 of the fixed seat 20, and a terminal end of the first adjusting screw 53 is connected with the blade holder 51. The first displacement sensor 54 is disposed on the first adjusting screw 53 and measures the vertical displacement of the first adjusting screw 53.

Referring to FIG. 5, by the configuration design of the edge band fine trimming mechanism 10 of this embodiment, when the edge banding process is to be performed to a workpiece W of different size and thereby the position of the scraper assembly 50 needs adjustment, the technician for the edge banding machine only needs to rotate the first adjusting screw 53 to vertically adjust the blade holder 51 and the blade 52 of the scraper assembly 50 together along the scraper installation groove 22. During the adjusting process, only one of the coordinates of the blade tip of the blade 52 is changed, which means the blade 52 is only moved vertically, so that the technician for the edge banding machine only needs to correspondingly adjust the position of the first feeler wheels 31 in the following process to complete the entire correcting process for the edge band fine trimming mechanism 10. Therefore, the positions of the scraper assembly 50 and the second feeler wheel 41 can be adjusted fast and conveniently, that effectively lowers the inconvenience in correcting the scraper assembly 50 and the second feeler wheel 41.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An edge band fine trimming mechanism of an edge banding machine, which is applied to a workpiece with an edge band adhered thereto, the edge band fine trimming mechanism comprising:

a fixed seat comprising a scraper installation groove, the scraper installation groove extending vertically;

a first feeler wheel assembly comprising a first feeler wheel, the first feeler wheel being vertically and rotatably disposed on a right side of the fixed seat;

a second feeler wheel assembly comprising a second feeler wheel, the second feeler wheel being horizontally and rotatably disposed on a bottom side of the fixed seat;

a scraper assembly disposed on the fixed seat and adapted to trim an end edge of the edge band, the scraper assembly comprising a blade holder and a blade, the blade holder comprising a vertical section and an inclined section, the vertical section being vertically and movably disposed in the scraper installation groove, the inclined section being connected to a bottom end of the vertical section and extending toward a boundary between the first feeler wheel and the second feeler wheel, the blade being disposed at a terminal end of the inclined section;

wherein the fixed seat further has an upper threaded hole; the scraper assembly further comprises a first adjusting screw; the first adjusting screw is screwed into the upper threaded hole of the fixed seat and a terminal end of the first adjusting screw is connected with the blade holder.

2. The edge band fine trimming mechanism as claimed in claim 1, wherein the scraper assembly further comprises a first displacement sensor; the first displacement sensor is disposed on the first adjusting screw and measures a vertical displacement of the first adjusting screw.

3. The edge band fine trimming mechanism as claimed in claim 1, wherein the fixed seat has a fastening threaded hole; the vertical section has an elongated hole; a fastening screw is inserted through the elongated hole and screwed into the fastening threaded hole.

4. The edge band fine trimming mechanism as claimed in claim 1, wherein the scraper installation groove has a first inner wall and a second inner wall, which are arranged oppositely to each other; a peripheral surface of the blade holder fitly contacts the first inner wall and the second inner wall at a same time.

5. An edge band fine trimming mechanism of an edge banding machine, which is applied to a workpiece with an edge band adhered thereto, the edge band fine trimming mechanism comprising:

a fixed seat comprising a scraper installation groove, the scraper installation groove extending vertically;

a first feeler wheel assembly comprising a first feeler wheel, the first feeler wheel being vertically and rotatably disposed on a right side of the fixed seat;

a second feeler wheel assembly comprising a second feeler wheel, the second feeler wheel being horizontally and rotatably disposed on a bottom side of the fixed seat;

a scraper assembly disposed on the fixed seat and adapted to trim an end edge of the edge band, the scraper assembly comprising a blade holder and a blade, the blade holder comprising a vertical section and an inclined section, the vertical section being vertically and movably disposed in the scraper installation groove, the inclined section being connected to a bottom end of the vertical section and extending toward a boundary between the first feeler wheel and the second feeler wheel, the blade being disposed at a terminal end of the inclined section;

wherein the second feeler wheel assembly further comprises a supporting frame and a second adjusting screw; the supporting frame is disposed on the fixed seat in a horizontally movable manner; the second feeler wheel is rotatably disposed at a terminal end of the supporting frame; the fixed seat further has a lower threaded hole; the second adjusting screw is screwed into the lower threaded hole of the fixed seat and a terminal end of the second adjusting screw is connected with the supporting frame.

6. The edge band fine trimming mechanism as claimed in claim 5, wherein the second feeler wheel assembly further comprises a second displacement sensor; the second displacement sensor is disposed on the second adjusting screw and measures a horizontal displacement of the second adjusting screw.

7. The edge band fine trimming mechanism as claimed in claim 5, wherein the supporting frame has a first section and a second section; the first section is connected with the second section; a direction which the first section extends toward is perpendicular to another direction which the second section extends toward; the second feeler wheel is rotatably disposed on the first section; the second adjusting screw is connected with the second section.

8. The edge band fine trimming mechanism as claimed in claim 7, wherein the second section further has an elongated hole; the bottom side of the fixed seat has a threaded hole; the threaded hole is located correspondingly to the elongated hole; a screw is inserted through the elongated hole of the second section and screwed into the threaded hole.

9. An edge band fine trimming mechanism of an edge banding machine, which is applied to a workpiece with an edge band adhered thereto, the edge band fine trimming mechanism comprising:

a fixed seat comprising a scraper installation groove, the scraper installation groove extending vertically;

a first feeler wheel assembly comprising a first feeler wheel, the first feeler wheel being vertically and rotatably disposed on a right side of the fixed seat;

a second feeler wheel assembly comprising a second feeler wheel, the second feeler wheel being horizontally and rotatably disposed on a bottom side of the fixed seat;

a scraper assembly disposed on the fixed seat and adapted to trim an end edge of the edge band, the scraper assembly comprising a blade holder and a blade, the blade holder comprising a vertical section and an inclined section, the vertical section being vertically and movably disposed in the scraper installation groove, the inclined section being connected to a bottom end of the vertical section and extending toward a boundary between the first feeler wheel and the second feeler wheel, the blade being disposed at a terminal end of the inclined section;

wherein the first feeler wheel assembly comprises a plurality of said first feeler wheels and a fixing member; the fixing member is disposed on the fixed seat in a vertically movable manner; the plurality of said first feeler wheels are all vertically and rotatably disposed on the fixing member; the plurality of said first feeler wheels are all located at a same predetermined height.

* * * * *